US009728172B1

(12) United States Patent
Perez

(10) Patent No.: US 9,728,172 B1
(45) Date of Patent: Aug. 8, 2017

(54) SYSTEM AND METHOD TO INTERFACE AND CONTROL MULTIPLE MUSICAL INSTRUMENT EFFECTS MODULES ON A COMMON PLATFORM

(71) Applicant: John A. Perez, Chandler, AZ (US)

(72) Inventor: John A. Perez, Chandler, AZ (US)

( * ) Notice: Subject to any disclaimer, the term of this patent is extended or adjusted under 35 U.S.C. 154(b) by 0 days.

(21) Appl. No.: 15/091,232

(22) Filed: Apr. 5, 2016

(51) Int. Cl.
*G10H 1/18* (2006.01)
*G10H 1/34* (2006.01)
*G10H 1/043* (2006.01)

(52) U.S. Cl.
CPC ..... *G10H 1/18* (2013.01); *G10H 1/043* (2013.01); *G10H 1/348* (2013.01); *G10H 2220/116* (2013.01); *G10H 2240/161* (2013.01); *G10H 2240/211* (2013.01)

(58) Field of Classification Search
CPC ..... G10H 1/18; G10H 1/043; G10H 1/348; G10H 2220/116; G10H 2240/161; G10H 2240/211
USPC ..... 84/615
See application file for complete search history.

(56) References Cited

U.S. PATENT DOCUMENTS 4,479,238 A 10/1984 Spector
6,215,055 B1 * 4/2001 Saravis ..... G10H 1/348 84/422.1
7,005,571 B1 * 2/2006 Groff ..... G10H 1/348 84/615
7,373,210 B2 * 5/2008 Pennock ..... G10H 1/02 381/118
7,525,038 B2 * 4/2009 Yamada ..... G10H 1/0091 84/622
8,166,397 B2 4/2012 Quandt
8,642,870 B1 * 2/2014 Rosa ..... A47G 27/0212 84/453
8,916,761 B2 12/2014 Robertson
2010/0229710 A1 * 9/2010 Schoewer ..... G10H 1/0066 84/701
2010/0269670 A1 * 10/2010 O'Connor ..... G10H 1/0091 84/626
2011/0271821 A1 * 11/2011 Mckinney ..... G10H 1/348 84/746
2013/0118340 A1 5/2013 D'Amours
2013/0312588 A1 * 11/2013 Orshan ..... G10H 1/0091 84/609
2013/0327201 A1 * 12/2013 Urry ..... G10H 1/06 84/626

(Continued)

*Primary Examiner* — Jeffrey Donels
(74) *Attorney, Agent, or Firm* — Inventive Patent Law P.C.; Jim H. Salter

(57) ABSTRACT

A system and method for interfacing and controlling multiple musical instrument effects modules on a common platform. The system includes: a system processor; a backplane coupled with the system processor; a plurality of musical instrument effects modules removably inserted into the backplane, each of the plurality of musical instrument effects modules including an audio input signal interface and an audio output signal interface, at least one of the musical instrument effects modules including a programmable potentiometer and/or programmable switch to modify an audio output signal; and a user interface configured to enable a user to apply a desired setting on the programmable potentiometer of the musical instrument effects modules via the system processor and the backplane.

18 Claims, 18 Drawing Sheets

(56) References Cited

U.S. PATENT DOCUMENTS

| | | | | |
|---|---|---|---|---|
| 2014/0090546 | A1* | 4/2014 | Ceccolini | G10H 1/02 84/626 |
| 2014/0205113 | A1 | 7/2014 | Slipp | |
| 2015/0262566 | A1* | 9/2015 | Ceccolini | G10H 1/348 84/746 |
| 2016/0019877 | A1* | 1/2016 | Remignanti | G10H 1/0066 84/645 |
| 2016/0063976 | A1* | 3/2016 | Wilk | G10H 1/055 84/626 |
| 2016/0258574 | A1* | 9/2016 | Abbate | F16M 13/02 |
| 2016/0293151 | A1* | 10/2016 | Mayo | G10H 1/34 |

* cited by examiner

SYSTEM AND METHOD TO INTERFACE AND CONTROL MULTIPLE MUSICAL INSTRUMENT EFFECTS MODULES ON A COMMON PLATFORM

TECHNICAL FIELD

Embodiments of the disclosure relate generally to the field of musical instrument effects pedal devices. Embodiments relate more particularly to a system and method for interfacing and controlling multiple musical instrument effects modules on a common platform.

BACKGROUND

The industry that manufactures musical instrument effects pedals for performing musicians has used a common product format throughout much of its history. A typical effects pedal has a ¼" phone jack input on the right, a ¼" phone jack output on the left, is powered by 9V DC from either a wall mounted power source or a battery, potentiometers and switches for the musician to adjust the desired effect and a large foot switch for the musician to either switch the desired effect on or off while performing. Throughout the industry, these pedals share compatible electrical characteristics, such as input impedance, output impedance, input voltage level sensitivity for adequate signal processing, and output voltage levels suitable for driving the next effects pedal or musical instrument amplifier in the signal chain. FIG. 1 illustrates the main components of a typical musical instrument effects pedal.

Effects pedals come with any number of potentiometers, switches and LED's to provide the user a variety of effects modifications and indications of particular effects currently selected. A large foot switch on the pedal allows the musician to either select the pedal for the desired effect or bypass the pedal effectively connecting the signal input to the output with no change to the signal having passed through the pedal. Because virtually all effects pedals share these common features, musicians are able to choose effects pedals from a variety of different effects pedal manufactures to achieve the desired musical tone of their particular guitar, bass or other musical instrument. Any number of pedals can be combined from one to several dozen or more. FIG. 2 illustrates a typical configuration for a set of musical instrument effects pedals a musician has chosen for his or her particular musical instrument effects requirements. In this example, only three musical instrument effects pedals are shown to illustrate the intent, but any number of pedals is possible.

There are thousands of different pedals from hundreds of different manufactures to choose from and they are electrically input and output compatible. This variety of different pedals also has another common feature in that they typically have potentiometers and switches that must be manually adjusted to change the desired effect. If a musician wishes to change an effect during a song, he or she must stop playing and reach down to turn a potentiometer or change a switch setting, which is impractical. Often the effect on the analog signal is very sensitive to the position of the potentiometer; so, it is very difficult to achieve the effect quickly and exact reproduction is limited to the players' patience. Most musicians simply set a particular pedal to a fixed effect and either switch it in or out of the signal path with a foot switch; hence, musical instrument effects pedals are often denoted by the term stomp box. The current method of manually adjusting potentiometers and toggling switches places restrictions on the user experience of achieving maximum tonal flexibility from any given pedal; so, most musicians simply set a stomp box to a particular effect and forget about changing it.

Thus far, the industry solution for improving the user experience of performing with a variety of effects pedals from various competing firms has been the introduction of the user configurable analog cross point switch. The cross point switch takes the input and output from every effects pedal into an array of ¼" phone jacks and circuitry internal to the cross point switch that can either bypass the effects pedal, place the effects pedal in the signal chain, reconfigure the order of the effects pedals, or any combination of these actions. The various configurations are determined beforehand by the musician and programmed into the cross point switch either by switches and a display on the cross point switch or by the aid of a computer over an interface. Most of these user interfaces are cryptic and require patience to understand and time to gain proficiency. It is important to note that the cross point switch does not modify the settings of the potentiometers or switches on the effects pedals plugged into it, including the footswitch. Effects pedals that are plugged into a cross point switch must be enabled continuously for the cross point switch to function. If an effects pedal is in the bypass state, there is no way for the cross point switch to change its state to make the effects pedal useful. FIG. 3 depicts a typical configuration for a cross point switch with several effects pedals. In addition to a cross point switch, it is typical to have a common power supply for numerous effects pedals. Such a configuration reduces the number of wall mounted power supplies and power strips; but, there are still a considerable number of ¼" phone jack interconnections and power cables connecting everything together.

SUMMARY

Example embodiments disclosed herein include a system and method for interfacing and controlling multiple musical instrument effects modules (which can be derived from musical instrument effects pedals) that can be new designs or existing designs having been modified by their manufacturer to interface onto a common platform. The example embodiments as disclosed herein allow manufacturers of musical instrument effects pedals (also referenced as stomp boxes inclusive of analog and/or digital effects circuitry) to redirect their current product lines from a simple isolated product with very limited control accessibility to a modular format that provides enhanced control and flexibility through a common modular digital interface under control of an embedded microprocessor and touch screen interface or a handheld device such as a mouse/trackball.

Some of the objectives of the various example embodiments disclosed herein include the following:

1. Provide a system and method to automatically control the setting of any potentiometer in an effects module from one position to another in a repeatable fashion at the request of the musician through a remote footswitch or touch panel interface.
2. Provide a system and method to automatically control the setting of any switch in an effects module from one position to another in a repeatable fashion at the request of the musician through a remote footswitch or touch panel interface.

3. Provide a system and method to dynamically control the bypass state of an effects module at the request of the musician through a remote footswitch or touch panel interface.
4. Provide a system and method to dynamically reorder the inputs and outputs of any effects module with any other effects module at the request of the musician through a remote footswitch or touch panel interface.
5. Provide a system and method to automatically perform the actions of any of the above and in any combination to any number of effects modules through a remote footswitch or touch panel interface.
6. Provide a system and method to create and store in a memory file a list of effects module configurations and effects module ordering and then recall any of the configurations to reconfigure the effects modules from their current configuration to the recalled configuration through a remote footswitch or touch panel interface.
7. Significantly reduce the number of ¼" phone jack interface cables, wall mounted power supplies, the physical size, and the weight of an effects pedal system.
8. Significantly reduce the number of components, such as switches, power jacks, ¼" phone jack cables, potentiometers, knobs, and metal housings of a musical instrument effects pedal system.
9. Employ a touch panel display to configure the effects modules individually through touch selection of an effects module, which lead to setup screens for configuration, and then store these configuration settings in a file system controlled by the main processor.
10. Provide access to a Wide-Area Data Network (WAN) from which the user can select configurations to upload and share or select shared configurations or data for download from sites such as social networks, web sites for module manufacturers, and other sources.
11. Provide access to the Wide-Area Data Network (WAN) from which the user can allow diagnostic and configuration information to be uploaded to a third party for maintenance and support activities.

BRIEF DESCRIPTION OF THE DRAWINGS

In the accompanying figures, similar reference numerals may refer to identical or functionally similar elements. These reference numerals are used in the detailed description to illustrate various embodiments and to explain various aspects and advantages of the present embodiments.

DETAILED DESCRIPTION OF EXAMPLE EMBODIMENTS

Example embodiments disclosed herein describe a system and method for interfacing and controlling multiple musical instrument effects modules on a common platform. The following detailed description is intended to provide example implementations to one of ordinary skill in the art, and is not intended to limit the invention to the explicit disclosure, as one or ordinary skill in the art will understand that variations can be substituted that are within the scope of the invention as described and claimed.

System Overview

Figure 4:
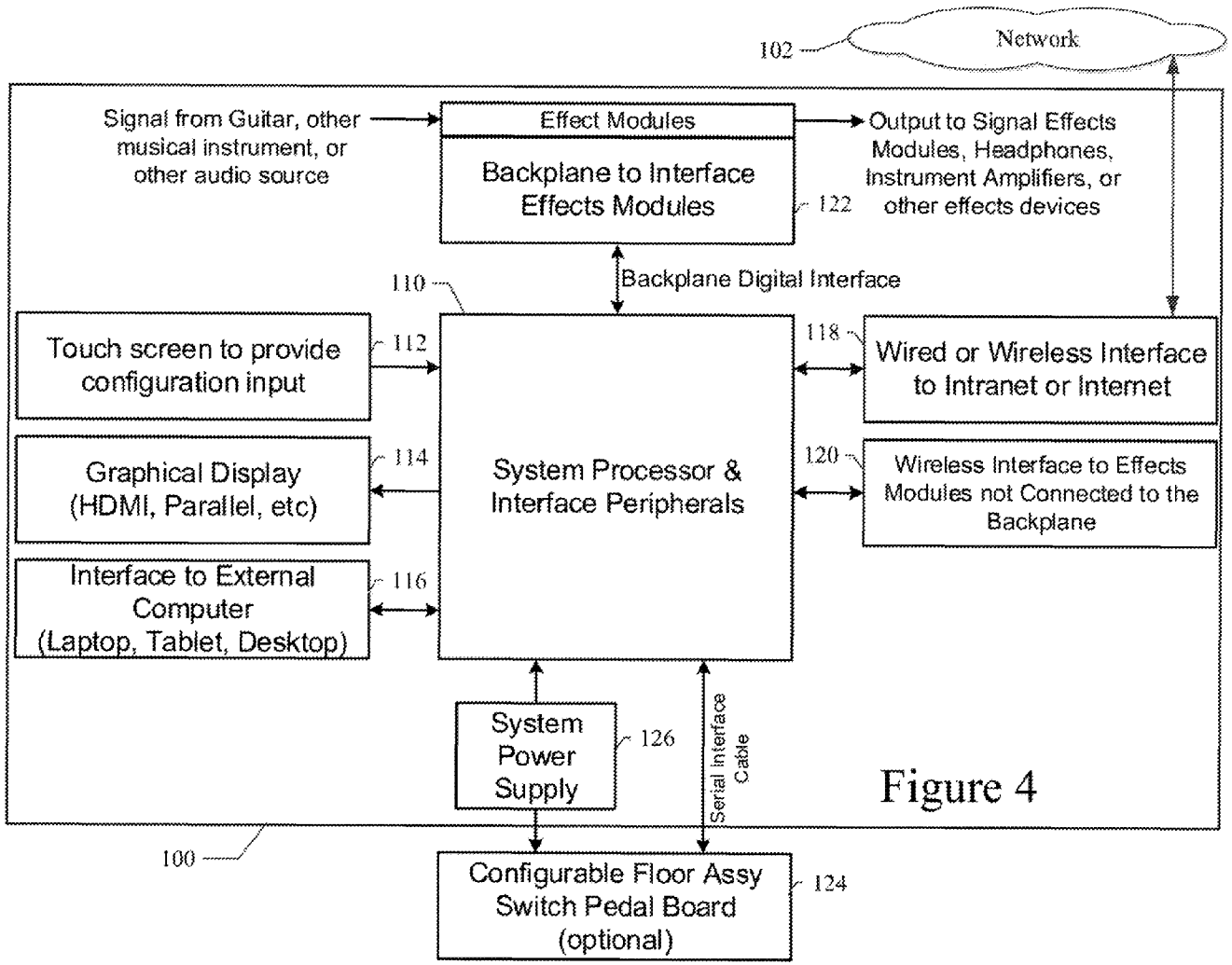
FIG. 4 illustrates a high level view of the components of the platform or system of an example embodiment.

FIG. 4 illustrates a high level view of the components of the system of an example embodiment. All of the components depicted in FIG. 4 with the exception of the Configurable Floor Assembly Switch Pedal Board 124 are contained in a single chassis called the unit or platform 100. The unit 100 contains a general purpose embedded processor system 110, an embedded graphical display 114 with touch screen 112, an interface 116 to an external computer, an interface 118 to an intranet or Wide-Area Data Network (WAN), such as the Internet, an interface to an external switch pedal board 124, a backplane 122, which supports a common interface for effects modules, and a local wireless interface 120 to modules not connected to the backplane. System setup instructions and module configurations are input to the system through a touch screen interface 112 or external computer 116. Once the system has been set up and configured, the module configurations can be recalled from either the touch screen interface 112 or the Configurable Floor Assembly Switch Pedal Board 124. A system power supply 126 provides all the required power supply voltages, power, and protection for the unit 100 and Configurable Floor Assembly Switch Pedal Board 124.

Effects pedals that have been modified to be compatible with the backplane 122 interface are inserted and mechanically attached to the backplane 122 of the unit 100. The modules essential electrical design critical to the overall tonal aspect of the module remain intact but have been adapted to fit onto a module such that the switches and potentiometers are electrically configurable and can be controlled over the backplane 122 digital interface by the system processor 110. The backplane 122 interface can support and control any number of modules.

The disclosure below provides a more detailed description of the overall system, unit 100, and the Configurable Floor Assembly Switch Pedal Board 124.

System Description of an Example Embodiment

Figure 5:
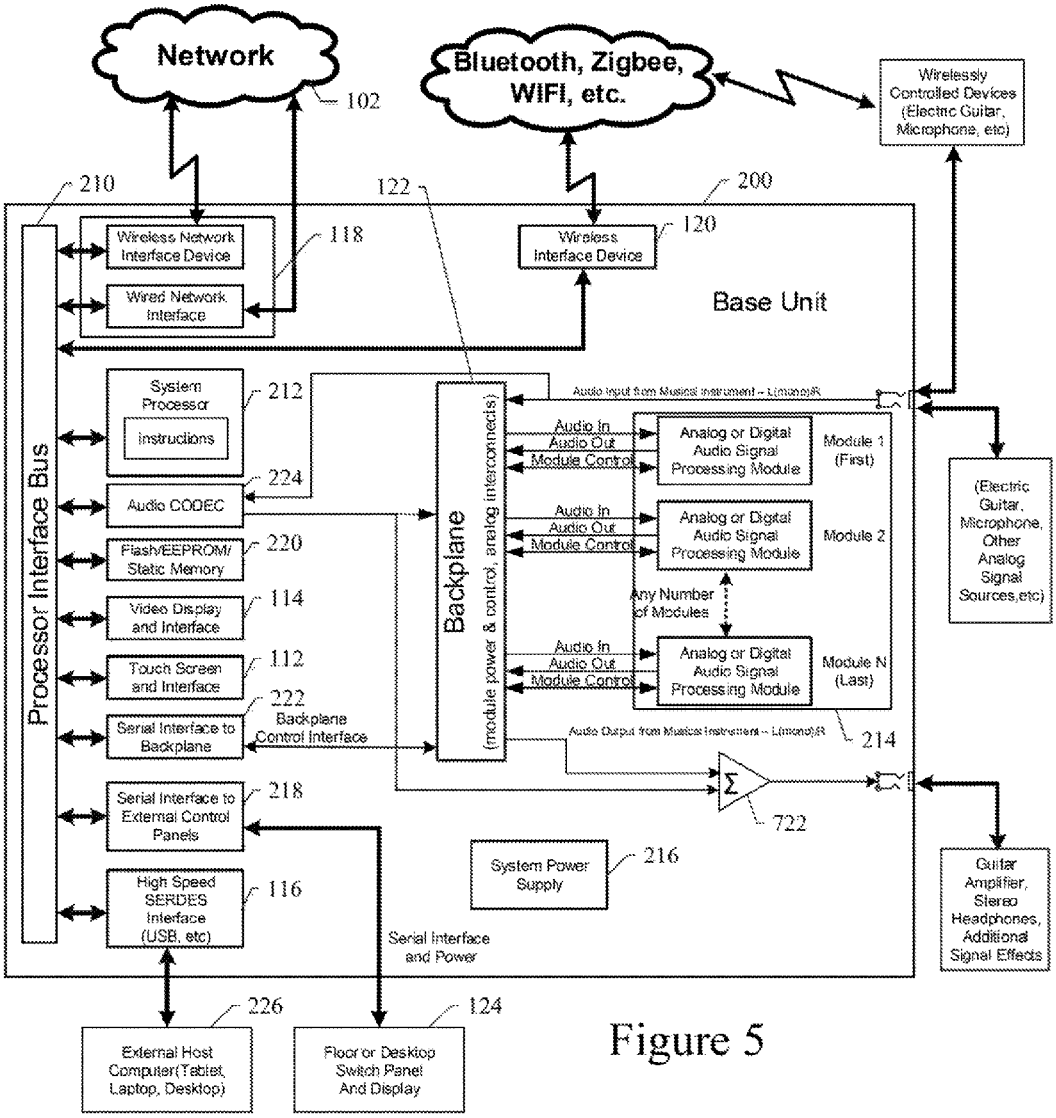
FIG. 5 illustrates an example embodiment of the platform or system for interfacing and controlling multiple musical instrument effects modules on a common platform.
Figure 5A:
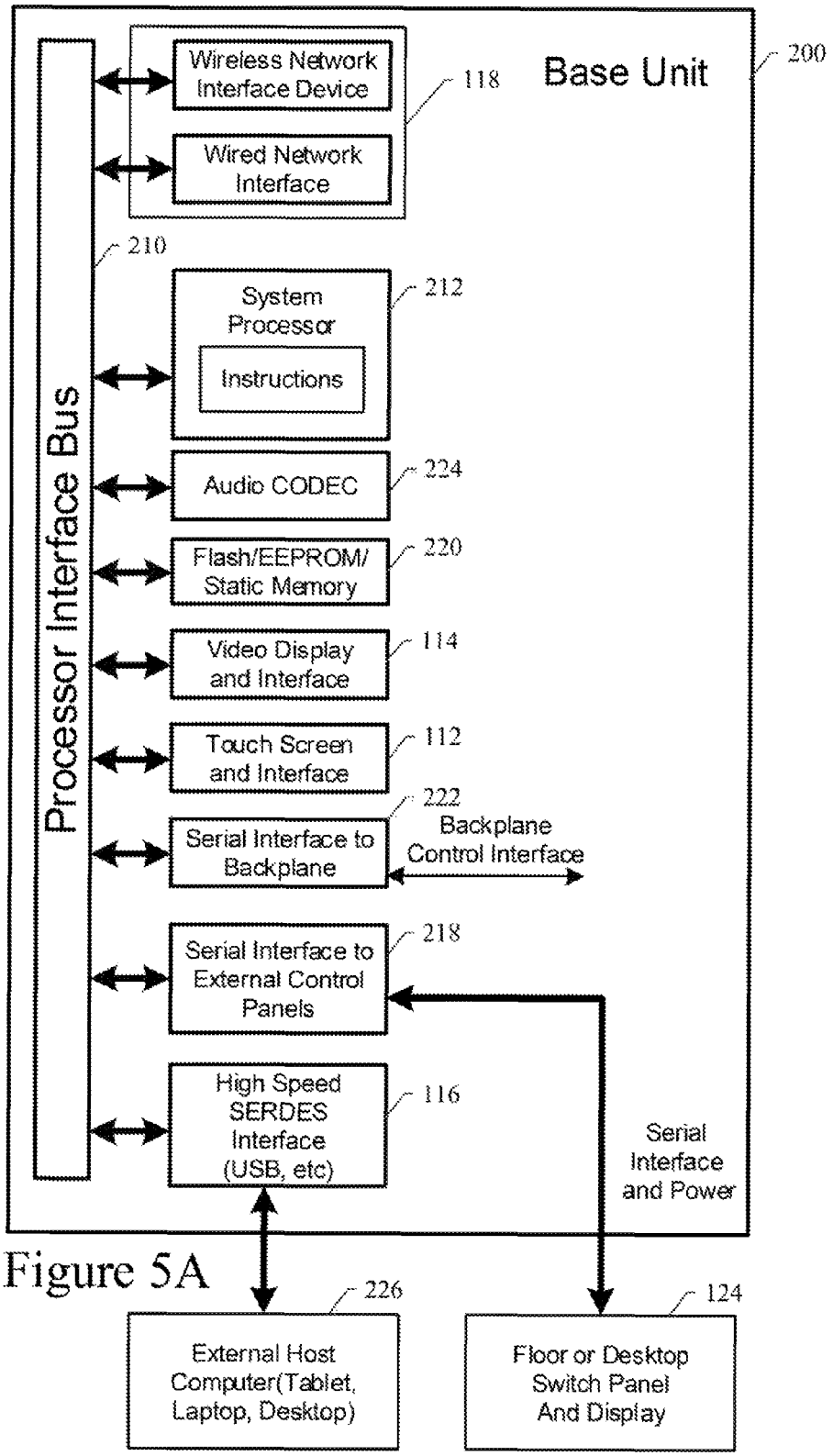
FIG. 5A illustrates an example embodiment of the processor interface bus components of the system.
Figure 5B:
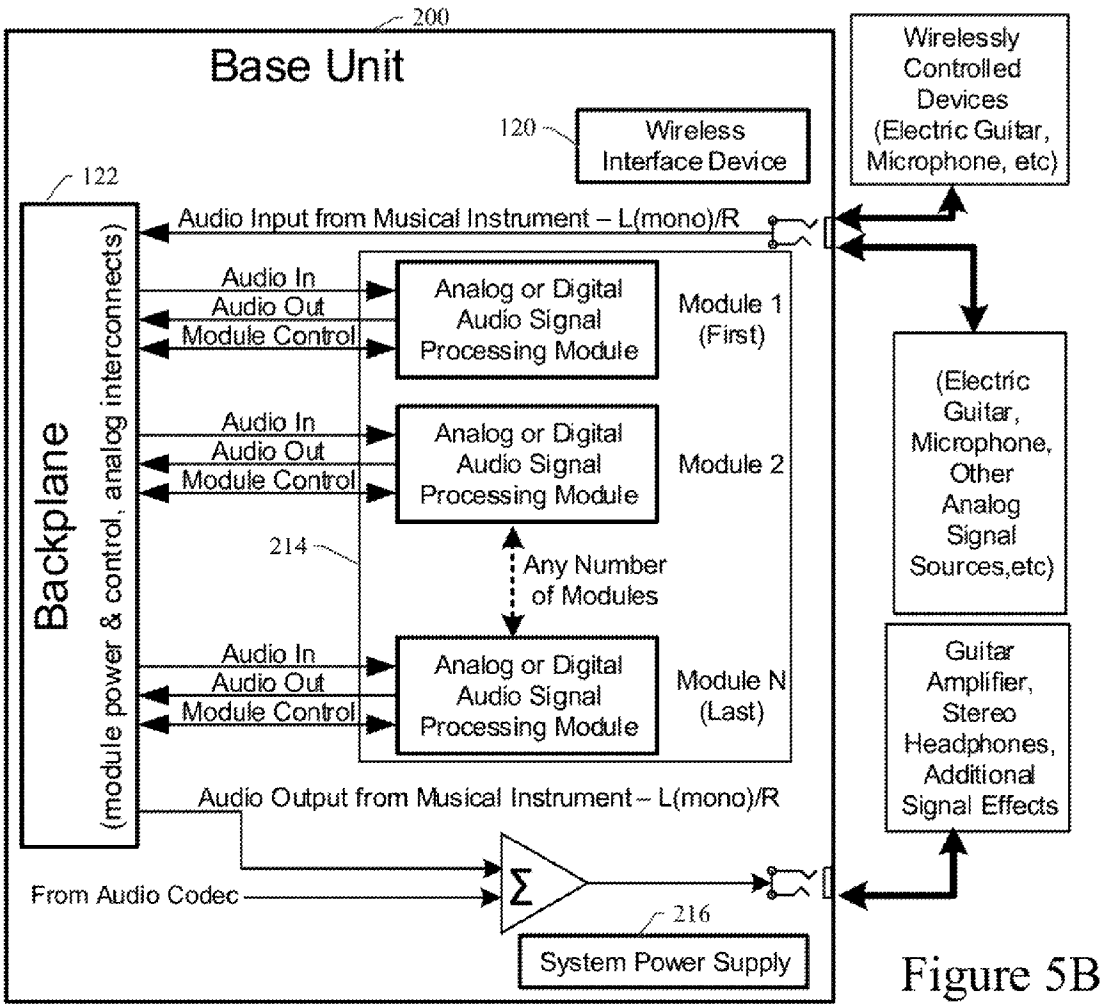
FIG. 5B illustrates an example embodiment of the backplane components of the system.

FIGS. 5, 5A, and 5B illustrate an example embodiment of a platform or system 200 for interfacing and controlling multiple musical instrument effects modules on a common platform. FIG. 5 illustrates an example embodiment of the whole system 200. FIG. 5A illustrates an example embodiment of the processor interface bus 210 components of the system 200. FIG. 5B illustrates an example embodiment of the backplane 122 components of the system 200. As shown in FIGS. 5 and 5A, the main components of the system 200 are the system processor 212 and instruction memory connected with a processor interface bus 210 and associated peripherals, a backplane 122 with connectors for interfacing any number of modules 214, a system power supply 216, a wireless interface 120 to control switches and potentiometers in guitars and microphones (or other local audio devices) not directly connected to the backplane 122, wired and/or wireless network interface 118 and an interface 218 for external control switch panels with numerical or graphical displays. The system processor 212 executes programming instructions located in a non-volatile memory 220 on the system processor interface bus 210 to control all aspects of the system 200 and its interfaces. The program is supported by an operating system such as Linux™ or Microsoft™ Windows™ but programs that are written to directly support the system 200 components without the use of an operating system can also be used.

As shown in FIGS. 5 and 5B, the various modules 214 that interface to the backplane 122 are controlled via interface drivers executed on the system processor 212. The interface drivers translate processor instructions to a protocol specifically intended to adjust the digital potentiometers, switches, and control elements of the modules 214 in a programmable manner. The translated protocol instructions or control signals for potentiometers and switch control are sent to the backplane 122 via interface 222. Each module 214 has an audio input signal interface and an audio output signal interface. If the backplane 122 in the unit 100 is a Type I (explained below) backplane interface, the ordering of the modules 214 is fixed in the system 200 and the analog signal effects of the modules 214 is dependent on the module order. If the backplane 122 in the unit 100 is a Type II (explained below) backplane interface, the ordering of the modules 214 is configurable through a cross-point-switch in the system 200 and the analog signal effects of the modules 214 is dependent on the configuration order as determined by the settings in the cross point switch. Also, in the case of the Type II backplane 122 interface, the input and output of the audio CODEC 224 controlled by system processor 212 can be connected to the input and output of any module 214 through the cross-point-switch to allow the system processor 212 to sample the analog signal via audio CODEC 224 to provide additional digital effects and to insert these digital effects at some point in the signal path as determined by the user. For both Type I and Type II backplane 122 interfaces, the addition of streaming audio to the analog effects signal from sources, such as prerecorded music, are supported via the audio CODEC 224 and circuitry provided to combine (sum) the two analog signals.

The system processor 212 has numerous peripherals that are used together to control the audio signal processing modules 214 via the backplane 122, control the external foot switch panel and display 124, control network communication on both internet and intranet, control a wireless interface 120 to configure signal processing modules that are not directly connected to the backplane 122, and control the various system interfaces to the user. These peripherals controlled by the system processor 212 include a network interface device 118 (a network interface), a wireless interface 120 (wireless device control interface), an audio codec 224 with stereophonic capability, memory components 220 to store programming instructions and data (e.g., Flash, EEPROM, SRAM, etc.), a touch screen interface 112, a graphical display interface 114, a serial interface 222 to control the backplane 122, a serial interface 218 to control external switch panels 124 and the high-speed serial interface bus 116 (computer interface) to interface with a local computer 226, such as a laptop or tablet. These serial interfaces can include, but are not limited to, SPI, I2C, UART, HDMI, RS-232 and MIDI.

The user configures the modules 214 by the touch screen interface 112 or an external computer 226 connected to the base unit 200 by either a wired or wireless network interface. Once the modules 214 are configured for a particular desired analog signal effect, the configuration can be stored with other configurations in a file system in nonvolatile memory 220 by the system processor 212 and together these configurations form a playlist. These configurations stored in the playlist can be recalled by the user via the touch screen interface 112 or the external foot control switch panel 124.

Musical Instrument Effects Module Description

Figure 6:
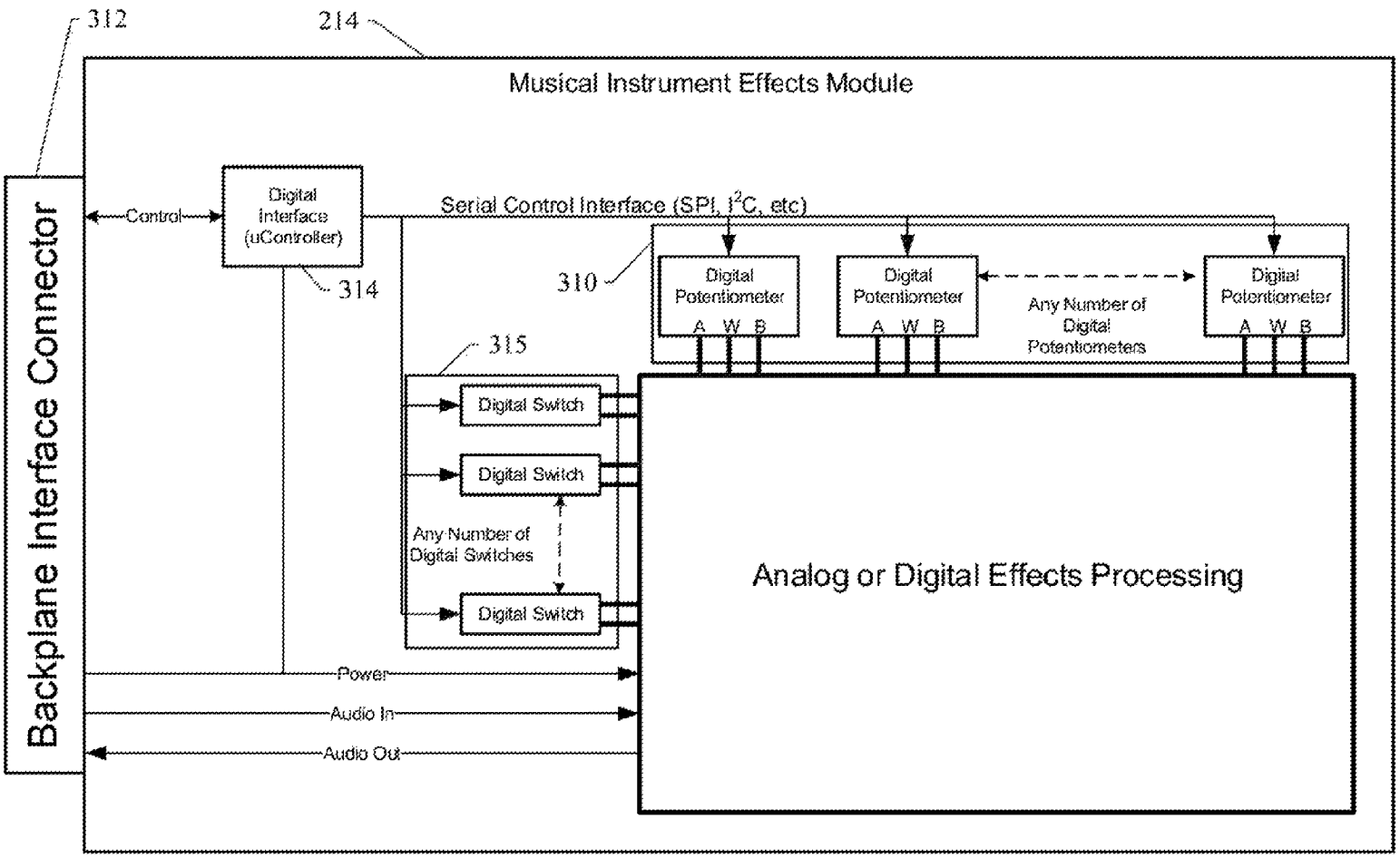
FIG. 6 illustrates a block diagram of an example embodiment of a typical backplane module.

FIG. 6 illustrates a block diagram of an example embodiment of a typical musical instrument effects module. The musical instrument effects modules 214 that contain the necessary electronics for signal processing are typically designed and built by firms that manufacture musical instrument effects pedals for the current market although they can be designed by any manufacturer. The manufacturers of products currently in the market will need to mechanically and electrically modify their products to adapt them to the system 200. These modifications include, but are not limited to, replacing the mechanical potentiometers with their digitally-controlled equivalents 310, replacing the mechanical switches with their digitally-controlled equivalents 315, interfacing the analog signals to the backplane 122 through a common interface connector 312, adding necessary digital and analog interface components 314 such that the modules 214 signal conditioning electronics can be controlled through the backplane 122 interface connector 312. The modified musical instrument effects module 214 is then installed into an enclosure suitable for mechanical installation onto the backplane 122 by a third party musician who has purchased the musical instrument effects module 214.

Note that the objective of system 200 is to control the method that the musical instrument effects module 214 uses to alter the signal by controlling the potentiometers and switches through a digital interface rather than mechanical means. The digital interface 314 is typically a microcontroller with an embedded software driver that receives commands from system processor 212, but digital interface 314 could be any form of digital logic. The digital interface 314 processes those commands to determine which potentiometer or switch to set and the value or position to set it to. Digital interface 314 will then execute that command across modules 214 internal digital interface to adjust the target switch 315 or potentiometer 310 to the desired setting commanded by system processor 212. The backplane 122 provides mechanical and electrical connection from digital interface 314 on modules 214 to the Serial Interface controller 222 connected to the processor interface bus, which is under the control of the system processor 212, which is executing instructions from its main memory. The user configures the module 214 through the touch screen interface 112 via system processor 212 or an externally connected personal computer (e.g., laptop, tablet, etc.) 226 and controls the unit 200 through these same devices or external control stomp box panel 124. Manufacturers may also chose to design a custom musical instrument effects module that will interface to the backplane interface 122 with no equivalent product currently on the market.

Backplane Interface

The backplane 122 of an example embodiment provides the common connector interface 312 for all modules 214 that are designed to physically interface to the system 200. All necessary power to the modules 214 as well as the serial control interface 222 to the digital interface 314 interconnect is provided by the backplane 122. In various example embodiments, there are two versions of the backplane 122 that can accept musical instrument effects module 214. These two versions of the backplane 122 are: Type-I and Type-II. Both types support single and stereophonic paths through the system 200 as well as any number of modules 214. These two versions of the backplane 122 in example embodiments are described in more detail below.

Type-I Backplane Interface Description

Figure 7:
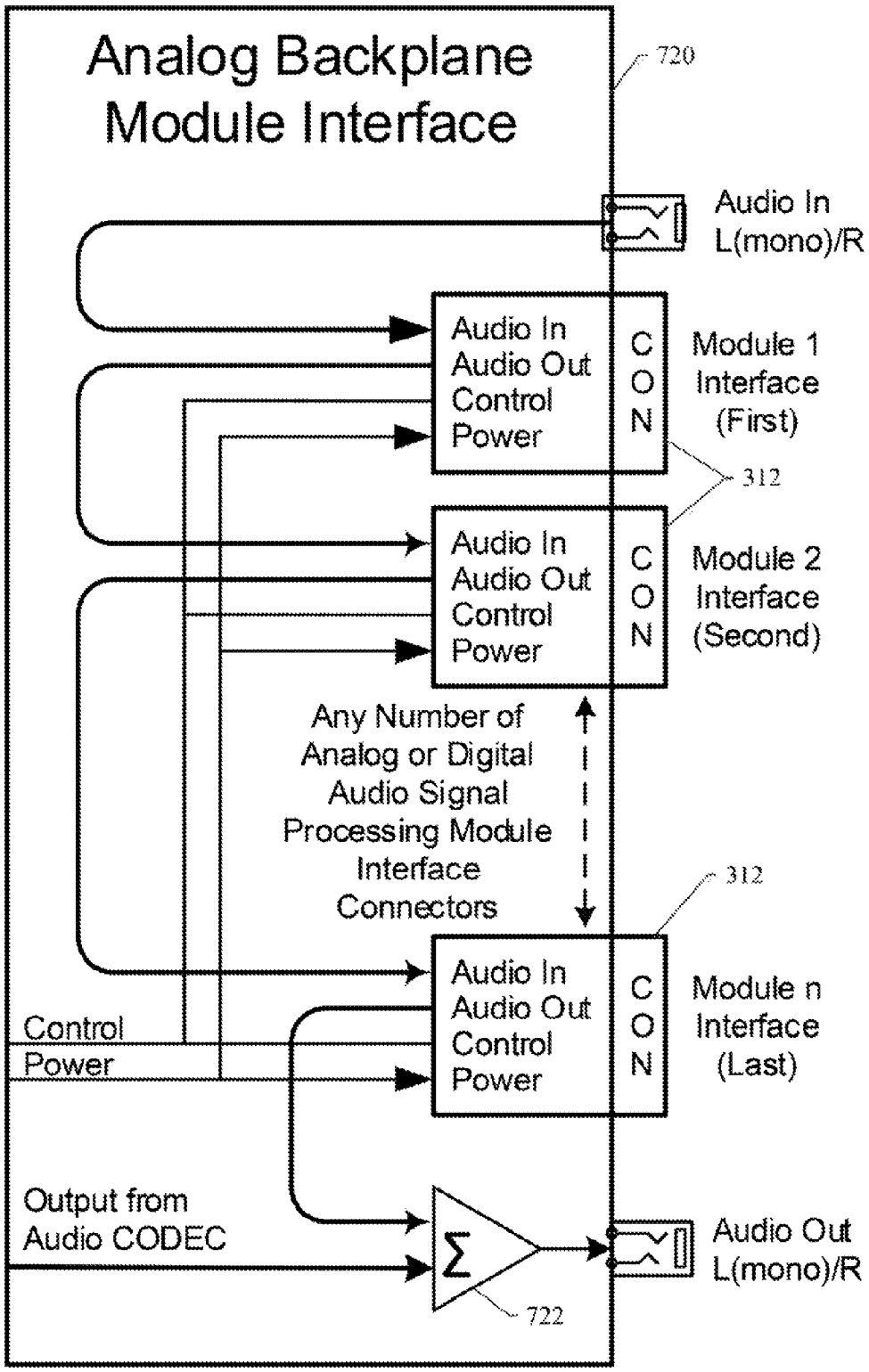
FIG. 7 depicts an example embodiment of a Type-I backplane.

FIG. 7 depicts an example embodiment of a Type-I backplane 720. Referring now to FIG. 7, the Type-I backplane 720 of an example embodiment has the capability to connect modules 214 in a fashion similar to configuration shown in FIG. 5, wherein the system takes the input from a musical instrument or microphone and connects the input to the first module 214 in the signal path. Every module's 214 output on the backplane 720 is then connected to the next module's 214 input. The last module 214 on the signal chain has its output connected to a summing circuit 722 to combine the final output with streaming audio generated by the system processor's CODEC 224. The output of the summing circuit 722 drives either an amplifier, headphones, or some other device for further signal processing.

Type-II Backplane Interface Description

Figure 8:
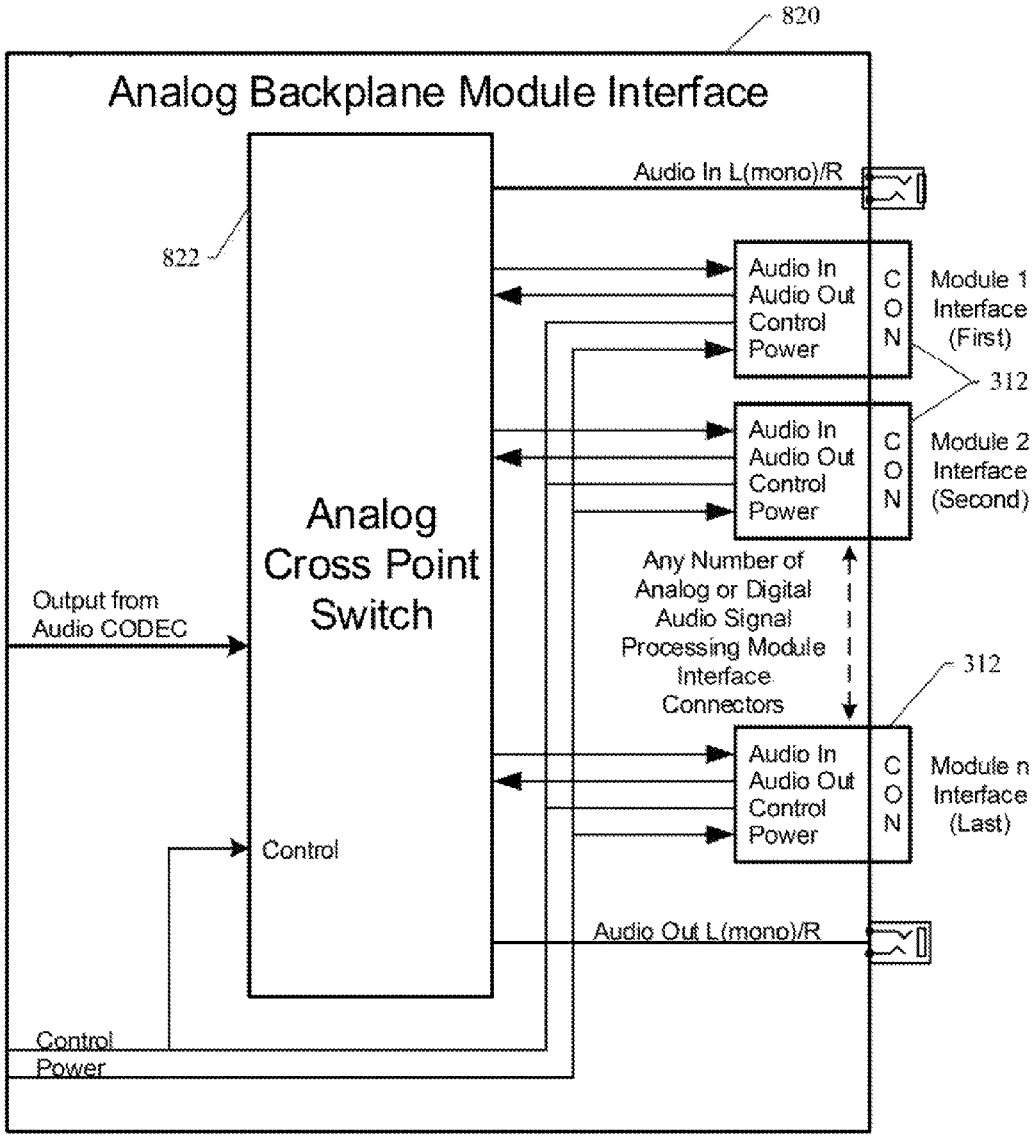
FIG. 8 depicts an example embodiment of a Type-II backplane.

FIG. 8 depicts an example embodiment of a Type-II backplane 820. Referring now to FIG. 8, the Type-II backplane 820 utilizes an analog cross point switch 822 to connect the inputs and outputs of the modules 214 as well as the inputs and outputs of the system in any conceivable configuration determined by the user and commanded by the system processor 212 over the backplane 122 control interface. In its simplest configuration, the Type-II backplane 820 can be configured to behave precisely like the Type-I backplane 720 described above. In the more complex configurations, the Type-II backplane 820 has the capability to reorder the inputs and outputs of all the modules 214, connect any number of modules 214 in parallel or serial, bypass all of the modules 214 and connect the input of the system to the output, and so on. It should be noted that the various configurations of the cross point switch 822 are stored along with the various configurations of the modules 214 in the playlist and are typically recalled with the playlist entry that reconfigures not only the cross point switch 822 but also the modules 214 that are connected to it through backplane 122.

Switch Panel and Display

Figure 1:
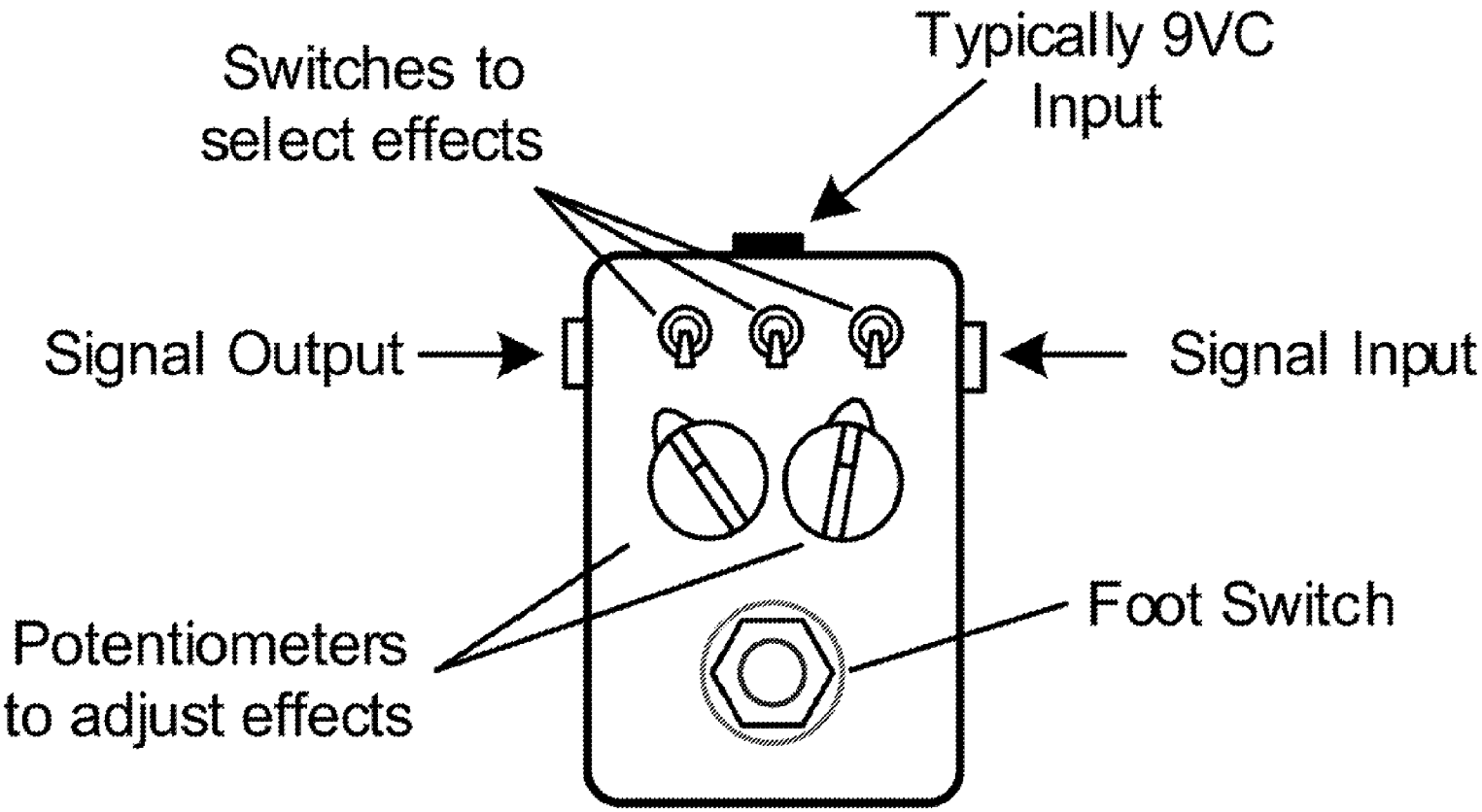
Figure 1 (Prior Art)
FIG. 1 illustrates the main components of a typical musical instrument effects pedal.
Figure 2:
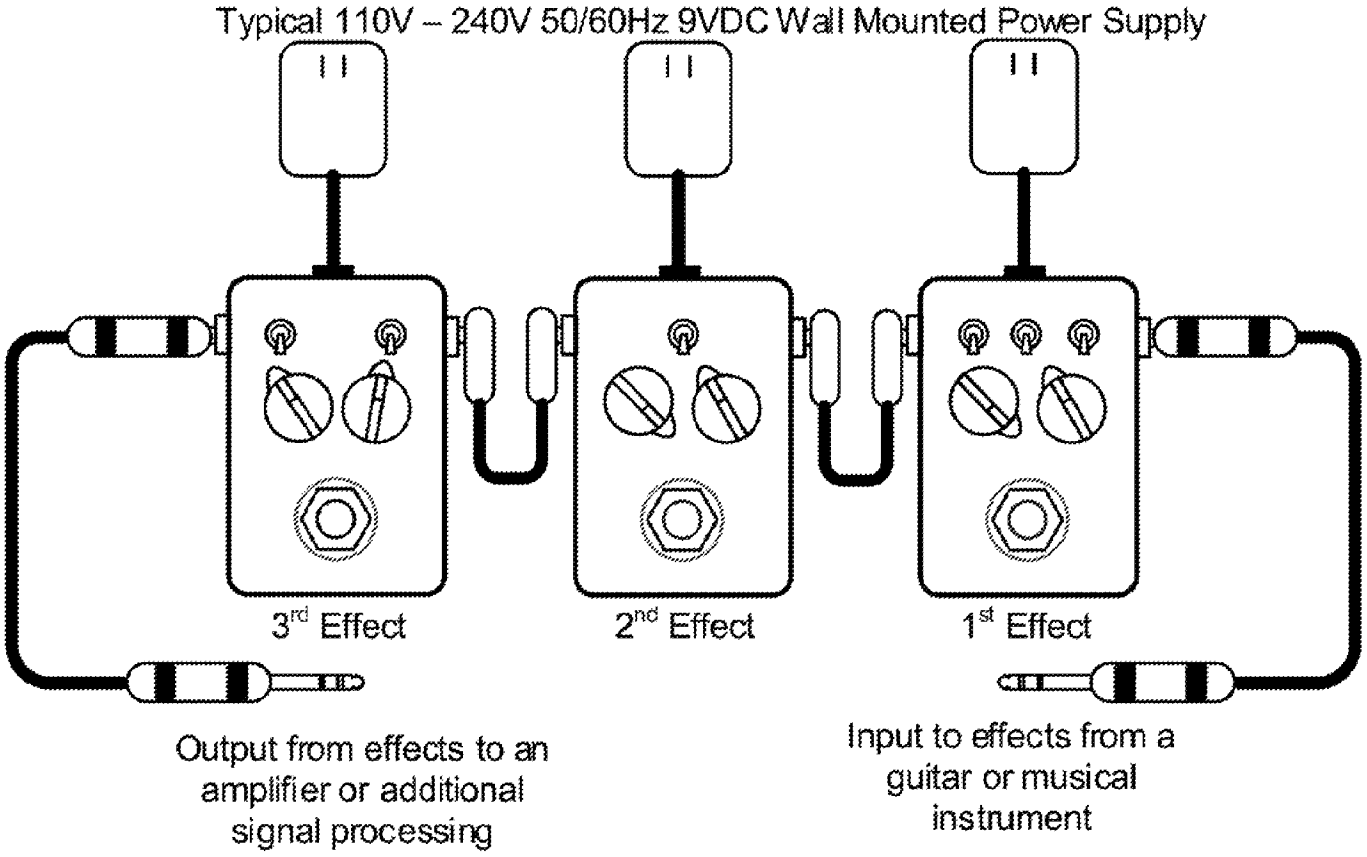
Figure 2 (Prior Art)
FIG. 2 illustrates a typical configuration for a set of musical instrument effects pedals a musician has chosen for his or her particular musical instrument effects requirements.
Figure 3:
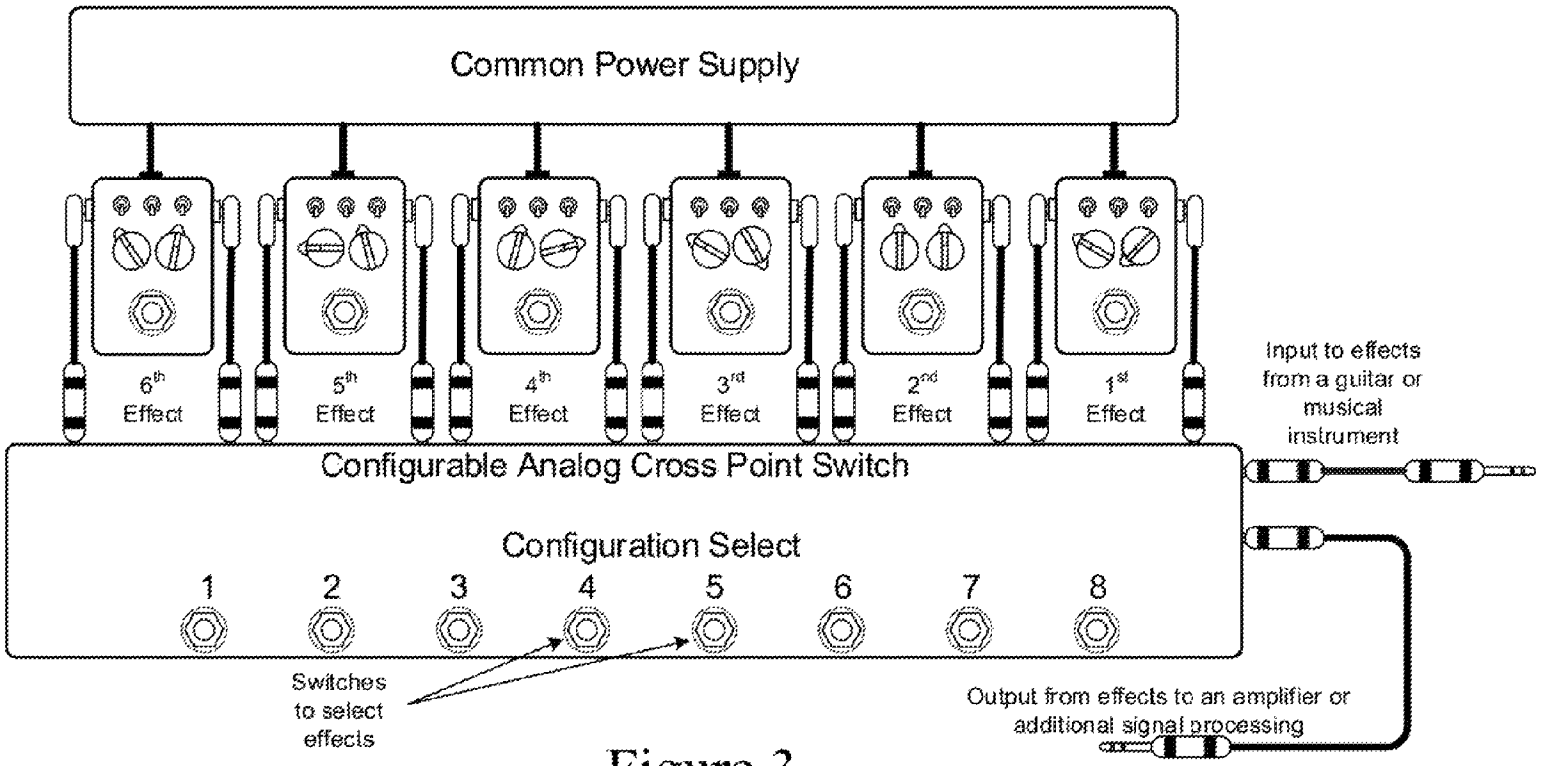
Figure 3 (Prior Art)
FIG. 3 depicts a typical configuration for a cross point switch with several effects pedals.
Figure 9:
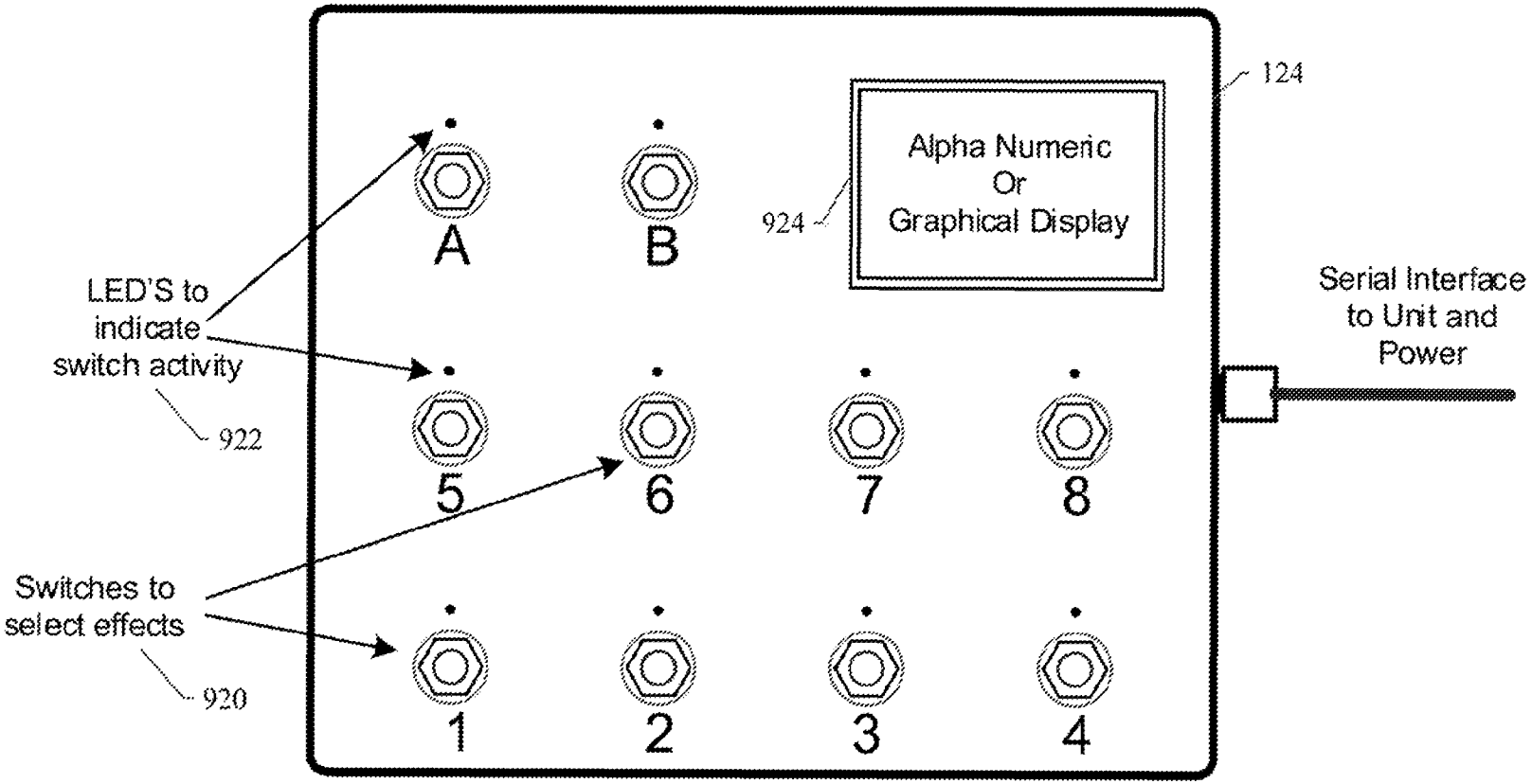
FIG. 9 depicts an example embodiment of a configurable floor pedal switch as described herein.

FIG. 9 depicts an example embodiment of a configurable floor pedal switch 124 as described above. The foot switch panel and display component 124 allows the user to control the system with the press of a foot switch 920 and for the panel to provide configuration feedback to the user with a graphical or numerical display 924 and LED's 922. In its most basic configuration, each switch 920 on the foot switch panel 124 behaves the same as a switch on a stomp box depicted in FIG. 1. In this configuration a foot switch 920 is assigned to a particular module 214 in the backplane 122 and is used to include the module 214 in the signal chain or place the module 214 in a bypass mode. In more complex configurations, a switch 920 is used for actions such as changing the entire configuration of the system. This type of switch assignment is useful for tasks such as stepping through a playlist of configurations that are stored in the system processor's 212 file system. For example, switch A, shown in FIG. 9, could be used to change the configuration to the next song on the playlist and switch B could be used to change the configuration to the previous song on the playlist. All three songs and other necessary information would be visible on the display 924 for immediate feedback to the user as to the current configuration of the system. The system processor 212 software allows for any conceivable configuration of the foot switches 920 on the panel 124 to support the user requirements and for display of any required information on the display 924. The LED's 922 typically present the status of the foot switch 920 position as either ON or OFF.

Figure 10:
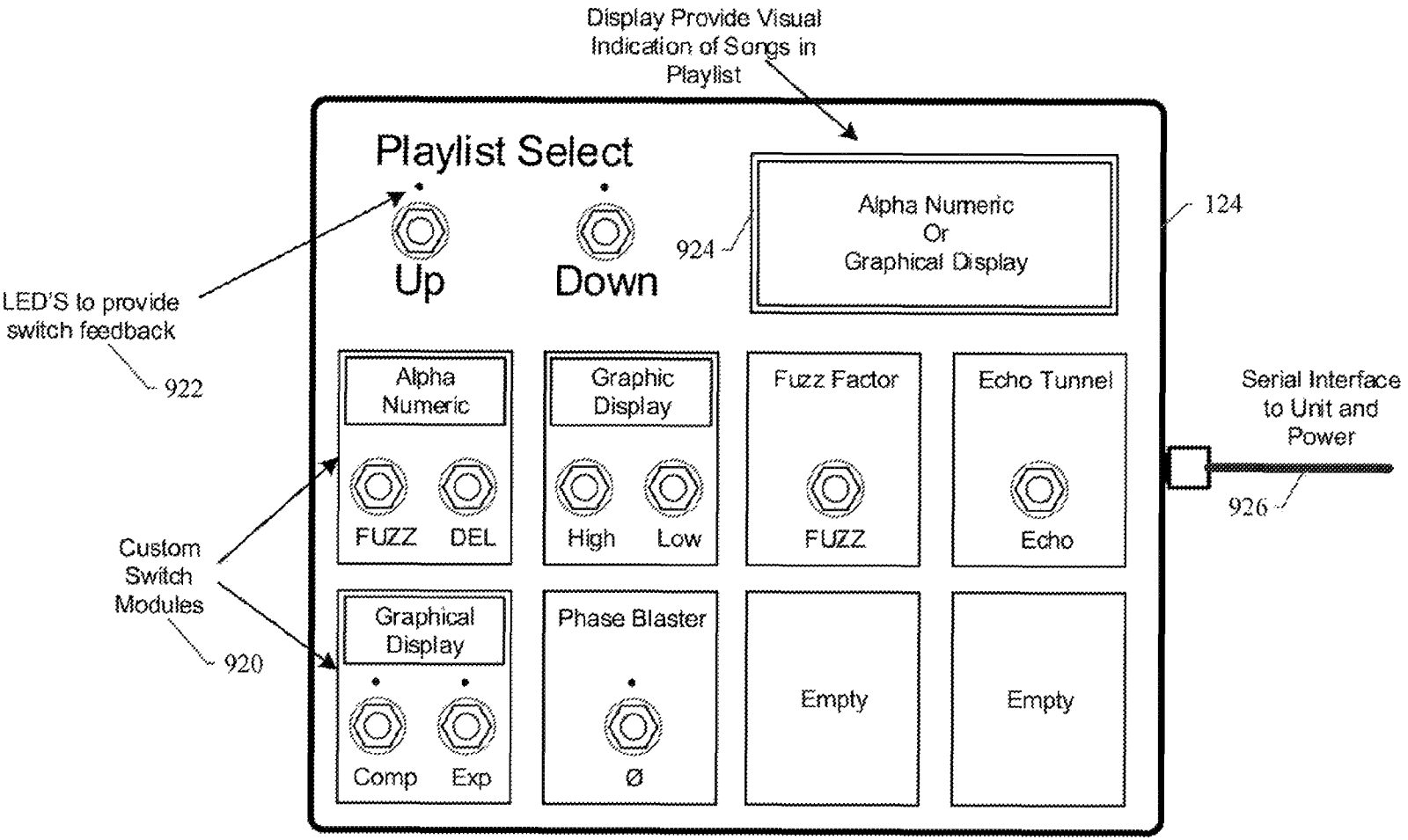
FIG. 10 illustrates a Custom Floor Pedal Switch and Display in an example embodiment.

FIG. 10 illustrates a Custom Floor Pedal Switch and Display 124 in an example embodiment. This Floor Pedal Switch and Display 124 performs the same basic function as the embodiment depicted in FIG. 9, except the foot switches 920 are mounted onto modules that are then mounted into a pedal board frame. The foot switch 920 modules are designed and built by the manufacturers of the modules 214 and conform to an electrical interface standard of the Custom Floor Pedal Switch and Display 124. The Custom Floor Pedal Switch and Display 124 housing accepts foot switch 920 modules that conform to a variety of physical sizes to accommodate foot switch pedals of varying complexity while limiting wasted floor pedal switch space. The electrical interface of a floor pedal module is through a connector that provides power and control signals to a circuit board, which in turn connects the Custom Floor Pedal Switch and Display 124 to the unit 200, typically over a serial interface cable 926 but any interface including a wireless interface can be used.

Power to the switch panel and display 124 is provided over a cable with a connector interface 926 such as MIDI or common RS-232 cable or a wall mounted power supply. Communication with the system processor 212 is provided over the cable with the connector interface 926 such as MIDI or common RS-232 cable and could also be provided wirelessly. The switch panel and display 124 contains necessary electronic circuitry and drivers required to support communication with the system processor 212, information presented to the display 924 and LED's 922, and detection of switch 920 closure.

User Interface

In various example embodiments, the user interface is somewhat different for systems with the Type I and Type II backplane as described above. For both types of backplanes, any number of modules 214 can be supported up to the maximum number of slots. For modules 214 inserted in the Type I backplane 720, the analog signal enters the effects chain starting at the module 214 inserted in slot one and proceeds through the modules 214 for additional effects from right to left until the last module 214. For modules 214 installed in the Type II backplane 820, the analog signal enters the effects chain starting at the module 214 assigned to position one and proceeds through the modules 214 for additional effects from right to left until the module 214 assigned to the last position. A slot is defined to be the physical location of a connector in the backplane 122 while a position is defined to be the virtual location of a module 214 in the signal path as connected physically by the cross point switch 822.

Systems with a Type I Backplane

Figure 11:
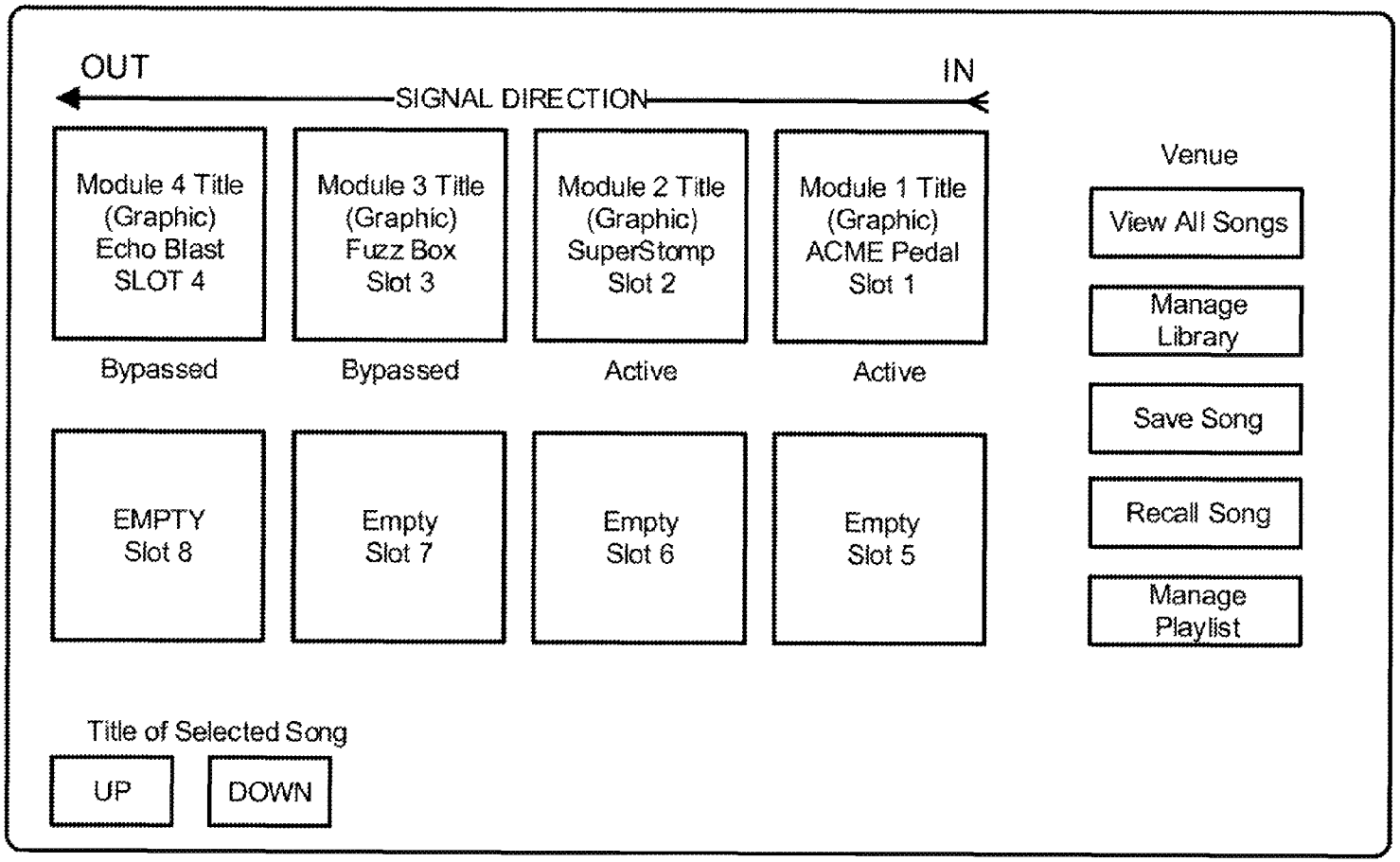
FIG. 11 illustrates an example embodiment of the graphical information displayed to the user for a four pedal system in an eight slot backplane.

In an example embodiment with a Type I backplane 720, the user can select the modules 214 to create the analog effects for their particular analog effects requirements and purchase these modules 214 from the various firms that manufacture products compatible with the system 200. These modules 214 are then inserted into the backplane 122 in the order that the user wishes the musical instrument effects to occur; but, the modules 214 can be placed in any order that the user desires. There is no standard for musical instrument effects module effects. After the modules 214 are inserted and mechanically affixed with screws, fasteners, or any other means, the system 200 is turned on. The system processor 212 will boot the operating system and a software application written to specifically support all the features of the system 200 is invoked either automatically or manually with the touch screen interface 112. Once the application is launched, the backplane 122 is interrogated by the system processor 212 over the backplane control interface 222 for any installed modules 214 and their physical location in the backplane 122. For detected installed modules 214, corresponding module 214 drivers are loaded into the application interface for that module 214. If the application cannot find the module driver in local memory, the application can access the Wide-Area Data Network (WAN) over the wireless (or wired) network interface 118 and locate the particular module 214 driver on the company website and download the module 214 driver. After the system processor 212 has determined the backplane 122 configuration as described above, the order of the modules 214 will be presented to the user on the graphical display 114 along with any options for user to select. FIG. 11 illustrates an example embodiment of the graphical information displayed to the user for a four pedal system in an eight slot backplane.

Figure 12:
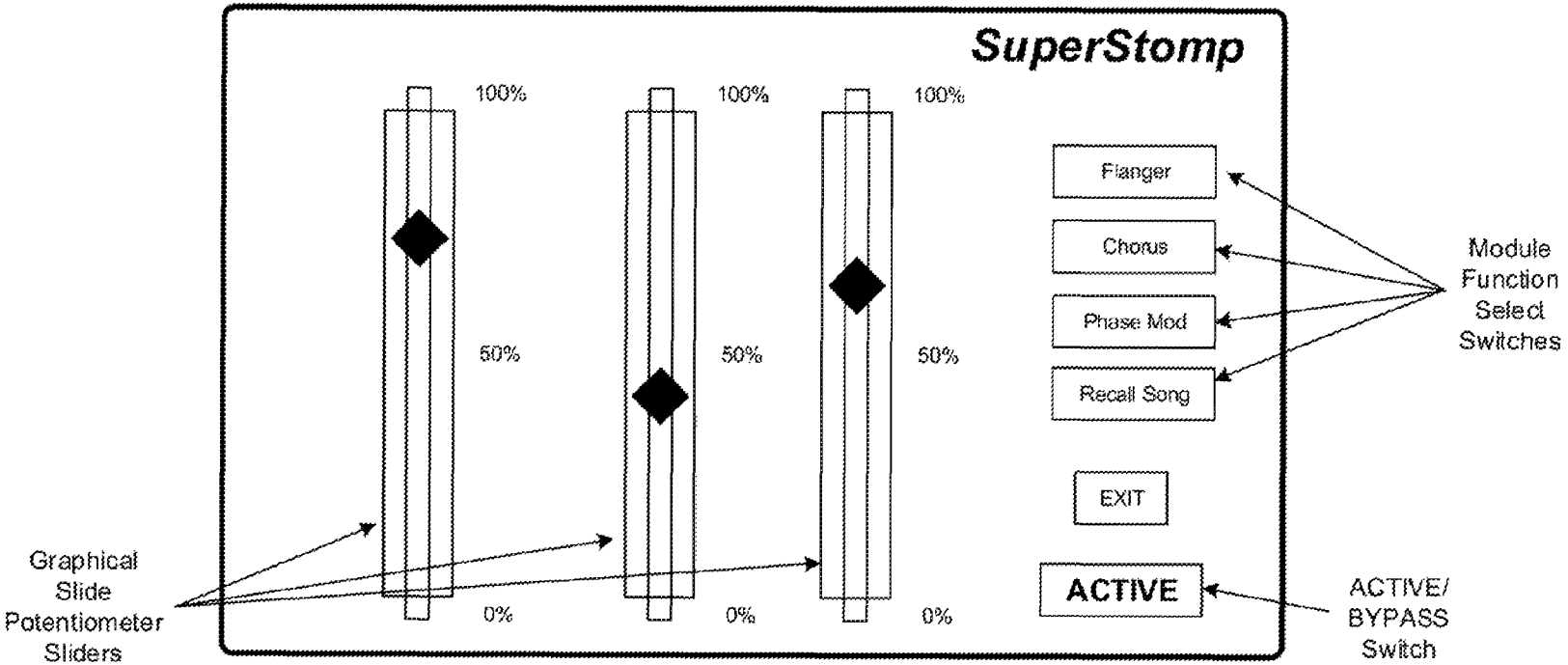
FIG. 12 illustrates an example embodiment including a graphical module interface on the graphical display in the example embodiment.

To configure a module 214, the user touches the display at the location of the module and a sub-menu is displayed on the graphical interface 114. FIG. 12 illustrates an example of a graphical module interface on the graphical display 114 in an example embodiment. Using the user interface, the user can touch a potentiometer graphic on the display 114 and slide a finger to move the graphical position indicator causing the touch screen interface 112 to provide potentiometer wiper positional information to the system processor 212. The system processor 212 then translates that positional information into a corresponding digital potentiometer setting and sends a command to the digital potentiometer 310 on the module 214 selected on the sub menu via the backplane 122 interface to set that potentiometer 310 to the positional setting. In a like manner, the configuration of the switches 314 select or deselect module functions via the system processor 212. The module 214 can be placed in the ACTIVE or BYPASS state with a switch object located on the touch screen 112. Note that setting a module 214 to the active state from the touch screen 112 can be changed to BYPASS remotely by pressing the modules switch 920 on the Switch Panel Display 124. Once the setup is complete, the user touches the EXIT switch, as shown in FIG. 12 to exit the menu and return to set up the remaining modules 214 in a similar manner. Once all the modules 214 have been configured to provide the desired analog effect to the musical instruments signals, the modules 214 configurations are saved to the system processor's 212 file system with a name, for example the name of the song for which the settings are intended. Once all of the various configurations have been captured and stored in the system processor's 212 file system, the collection of various configurations can be ordered into a playlist. This playlist can be stored in the system processor's 212 file system. The menu levels in the user interface can go to any required depth to support analog effects system or module features. The example shown in FIGS. 11 and 12 is only one menu layer deep.

Systems with a Type II Backplane

Figure 13:
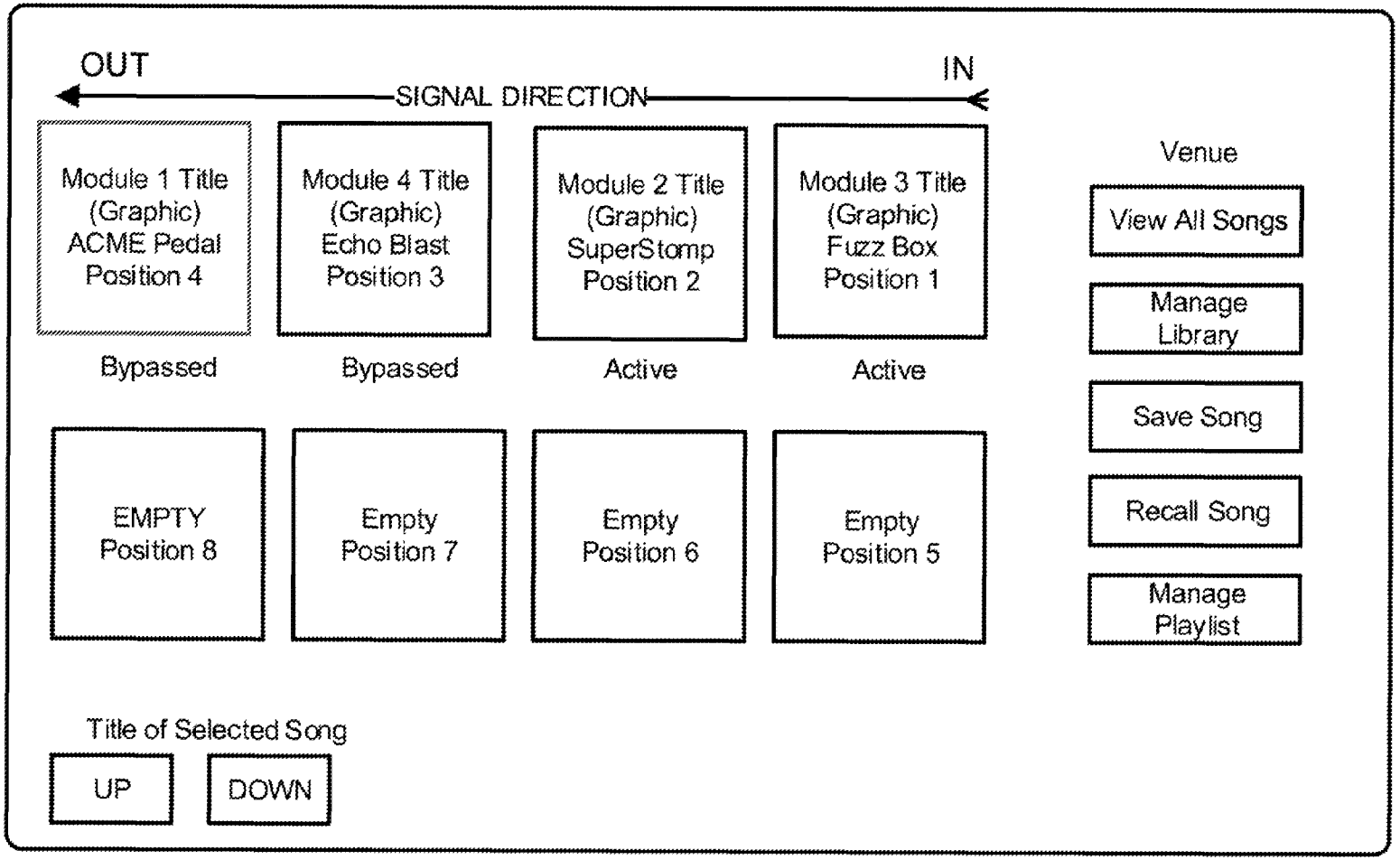
FIG. 13 illustrates an example embodiment including a menu for assigning module positions in a Type II backplane in the example embodiment.

The user experience is different for the Type II backplane 820 only with respect to how the order of the modules 214 is configured. With a Type II backplane 820, the user can insert the modules 214 into the backplane 122 in any order in the same manner as the Type I backplane 720. Once the system is powered up, the application running on system processor 212 can interrogate the backplane 122 for modules 214 inserted therein. The graphical information displayed to the user is similar to the Type I backplane 720 embodiment described above, except that for the Type II backplane 820 embodiment, the virtual position of the module 214 established by the cross point switch in the backplane 122 is significant, not the slot into which the module 214 is plugged. FIG. 13 illustrates an example embodiment of a user interface for a Type II backplane 820 embodiment including a menu for assigning module 214 positions in the Type II backplane 820. As shown in FIG. 13, the user can reposition the order of the modules 214 by touching and holding a finger on the displayed module object and dragging the module object to the desired position in the signal chain. When the user releases the touch, the corresponding module 214 will logically switch positions with the module 214 corresponding to the module object over which another module object was dragged. The system processor 212 will send a command across the backplane interface 312 to the analog cross point switch 822 to instruct the analog cross point switch 822 to reconnect the inputs and outputs of the corresponding modules 214 such that the analog signal flows through the modules 214 as they are depicted on the graphical interface shown in FIG. 13 rather than how modules 214 are physically ordered on the backplane 122. After all of the selected modules 214 have been configured, the configuration is stored in a play list in the system processor's 212 file system. The embodiment in FIG. 13 depicts the concept of a menu for assigning module positions in a Type II backplane. The virtual position of the module 214 is the order that the analog signal will flow through the analog effects and is displayed on the graphical interface shown in FIG. 13. This ordering may not be the same as the order the modules 214 are physically plugged into the backplane 122, which is the same as depicted in FIG. 11.

The various example embodiments described herein can provide several benefits and advantages over the existing systems. Some of these beneficial system configurations include the following:

A system that allows manufacturers of musical instrument effects pedals for the current market to adapt those products to a common platform for the purpose of reducing the quantity of power supplies, interconnecting cables, switches, potentiometers and reducing weight and size.

A system that provides a common interface for manufacturers of musical instrument effects pedals for the current market such that they are able to configure and control the potentiometers and switches of those products from a touch screen interface rather than turning potentiometer knobs and toggling switches.

A system that provides a common interface for manufacturers of musical instrument effects modules for the current market such that they are able to save the configurations of their products in a file system so they can be recalled at a later time.

A system that provides a common interface for manufacturers of musical instrument effects pedals for the current market such that they are able to recall the configurations of their products from a file system to enable rapid reconfiguring a system in a far shorter period of time.

A system that provides remote access to the musical instrument effects modules as well as the system for the purpose of maintenance, diagnostics and data collection.

A system that can dynamically reorder the signal path through a collection of musical instrument effects modules and also change their potentiometers and switch settings from a previously stored configuration in the system processors file system with the press of a single button. The reordering includes the virtual addition or removal of any module in the backplane.

A system that allows setting the potentiometers and switches of an electric guitar over a wireless interface with a touch screen interface and saving those setting in the system processors memory for the purpose of a playlist.

A system that allows changing the configuration of one or more musical instrument effects modules and the attached electric guitars tone adjustment potentiometers and switches from previously stored configuration in the system processors file system with the touch of a single switch.

Figure 14:
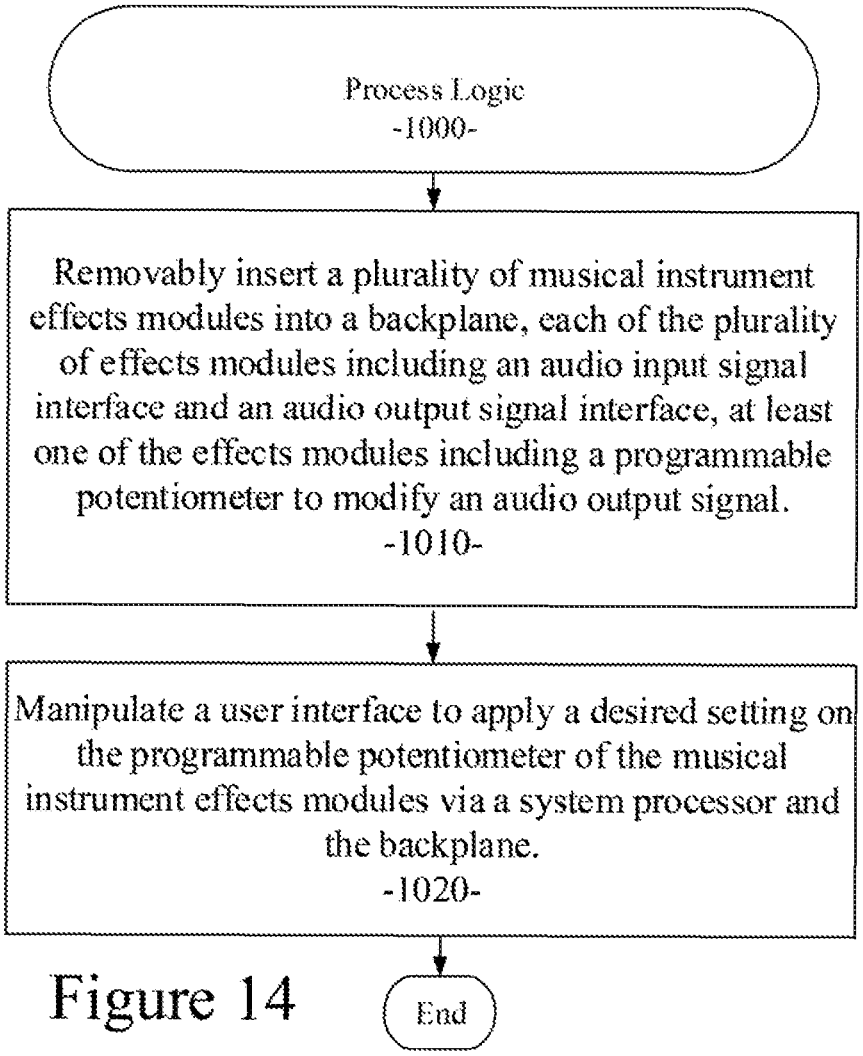
FIG. 14 is a flow chart illustrating a method for interfacing and controlling multiple musical instrument effects modules on a common platform, according to the embodiments as disclosed herein.

FIG. 14 is a flow chart illustrating a method for interfacing and controlling multiple musical instrument effects modules on a common platform, according to the embodiments as disclosed herein. In an example embodiment, the method 1000 includes: removably inserting a plurality of musical instrument effects modules into a backplane, each of the plurality of effects modules including an audio input signal interface and an audio output signal interface, at least one of the effects modules including a programmable potentiometer or switch to modify an audio output signal (operation block 1010); and manipulating a user interface to apply a desired setting on the programmable potentiometer or switch of the musical instrument effects modules via a system processor and the backplane (operation block 1020).

Figure 15:
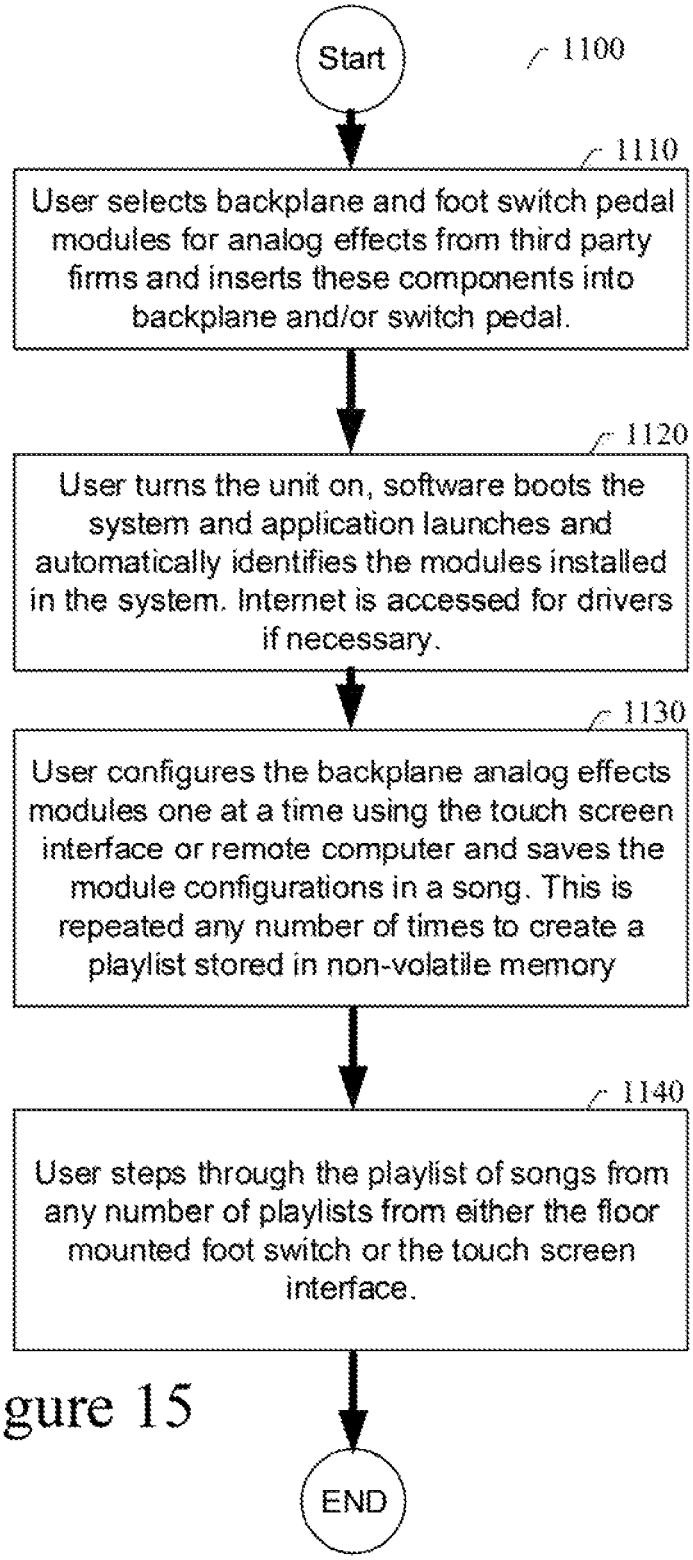
FIG. 15 is a flow chart illustrating another method for interfacing and controlling multiple musical instrument effects modules on a common platform, according to the embodiments as disclosed herein.

FIG. 15 is a flow chart illustrating another method for interfacing and controlling multiple musical instrument effects modules on a common platform, according to the embodiments as disclosed herein. In an example embodiment, the method 1100 includes the following operations: A user selects the backplane and foot switch pedal modules for analog effects from third party firms and inserts these components into the unit backplane and/or switch pedal (operation block 1110); the user turns the unit on, the unit software boots, the system and application launches and automatically identifies the modules installed in the system; the Internet is accessed for drivers if necessary (operation block 1120); the user configures the backplane analog effects modules one at a time using the touch screen interface or remote computer and saves the module configurations for a song; this is repeated any number of times to create a playlist stored in non-volatile memory (operation block 1130); and the user steps through the playlist of songs from any number of playlists from either the floor mounted foot switch or the touch screen interface (operation block 1140).

Figure 16:
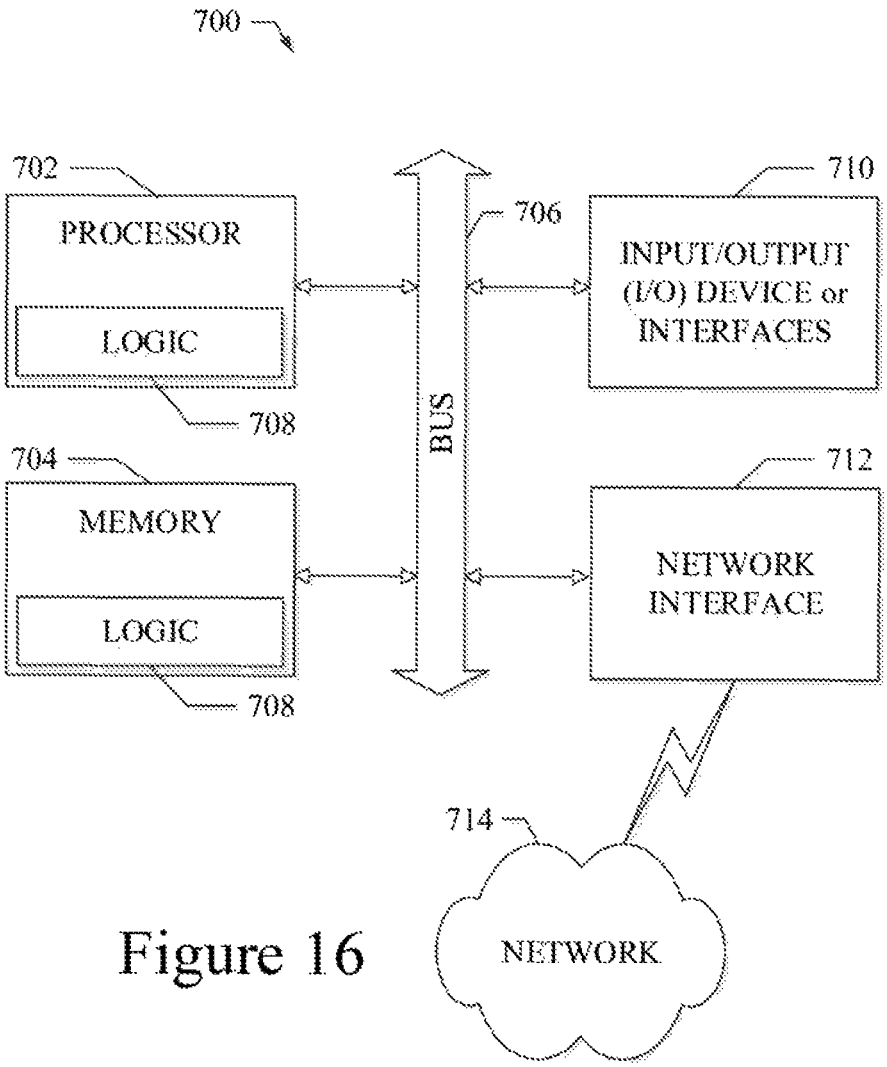
FIG. 16 shows a diagrammatic representation of machine in the example form of a computer system within which a set of instructions when executed may cause the machine to perform any one or more of the methodologies discussed herein.

FIG. 16 shows a diagrammatic representation of a machine in the example form of a stationary or mobile computing and/or communication system 700 within which a set of instructions when executed and/or processing logic when activated may cause the machine to perform any one or more of the methodologies described and/or claimed herein. In alternative embodiments, the machine operates as a standalone device or may be connected (e.g., networked) to other machines. In a networked deployment, the machine may operate in the capacity of a server or a client machine in server-client network environment, or as a peer machine in a peer-to-peer (or distributed) network environment. The machine may operate with a personal computer (PC), a laptop computer, a tablet computing system, a Personal Digital Assistant (PDA), a cellular telephone, a smartphone, a web appliance, a set-top box (STB), a network router, switch or bridge, or any machine capable of executing a set of instructions (sequential or otherwise) or activating processing logic that specify actions to be taken by that machine. Further, while only a single machine is illustrated, the term "machine" can also be taken to include any collection of machines that individually or jointly execute a set (or multiple sets) of instructions or processing logic to perform any one or more of the methodologies described and/or claimed herein.

The example stationary or mobile computing and/or communication system 700 can include a data processor 702 (e.g., a System-on-a-Chip (SoC), general processing core, graphics core, and optionally other processing logic) and a memory 704, which can communicate with each other via a bus or other data transfer system 706. The mobile computing and/or communication system 700 may further include various input/output (I/O) devices and/or interfaces 710, such as a touchscreen display, an audio jack, a voice interface, and optionally a network interface 712. In an example embodiment, the network interface 712 can include one or more radio transceivers configured for compatibility with any one or more standard wireless and/or cellular protocols or access technologies (e.g., 2nd (2G), 2.5, 3rd (3G), 4th (4G) generation, and future generation radio access for cellular systems, Global System for Mobile communication (GSM), General Packet Radio Services (GPRS), Enhanced Data GSM Environment (EDGE), Wideband Code Division Multiple Access (WCDMA), LTE, CDMA2000, WLAN, Wireless Router (WR) mesh, and the like). Network interface 712 may also be configured for use with various other wired and/or wireless communication protocols, including TCP/IP, UDP, SIP, SMS, RTP, WAP, CDMA, TDMA, UMTS, UWB, WiFi, WiMax, Bluetooth™, IEEE 802.11x, and the like. In essence, network interface 712 may include or support virtually any wired and/or wireless communication and data processing mechanisms by which information/data may travel between a mobile computing and/or communication system 700 and another computing or communication system via network 714.

The memory 704 can represent a machine-readable medium on which is stored one or more sets of instructions, software, firmware, or other processing logic (e.g., logic 708) embodying any one or more of the methodologies or functions described and/or claimed herein. The logic 708, or a portion thereof, may also reside, completely or at least partially within the processor 702 during execution thereof by the mobile computing and/or communication system 700. As such, the memory 704 and the processor 702 may also constitute machine-readable media. The logic 708, or a portion thereof, may also be configured as processing logic or logic, at least a portion of which is partially implemented in hardware. The logic 708, or a portion thereof, may further be transmitted or received over a network 714 via the network interface 712. While the machine-readable medium of an example embodiment can be a single medium, the term "machine-readable medium" should be taken to include a single non-transitory medium or multiple non-transitory media (e.g., a centralized or distributed database, and/or associated caches and computing systems) that store the one or more sets of instructions. The term "machine-readable medium" can also be taken to include any non-transitory medium that is capable of storing, encoding or carrying a set of instructions for execution by the machine and that cause the machine to perform any one or more of the methodologies of the various embodiments, or that is capable of storing, encoding or carrying data structures utilized by or associated with such a set of instructions. The term "machine-readable medium" can accordingly be taken to include, but not be limited to, solid-state memories, optical media, and magnetic media.

It is to be understood that although various components are illustrated herein as separate entities, each illustrated component represents a collection of functionalities which can be implemented as software, hardware, firmware or any combination of these. Where a component is implemented as software, it can be implemented as a standalone program, but can also be implemented in other ways, for example as part of a larger program, as a plurality of separate programs, as a kernel loadable module, as one or more device drivers or as one or more statically or dynamically linked libraries.

As will be understood by those familiar with the art, the various embodiments described herein may be embodied in other specific forms without departing from the spirit or essential characteristics thereof. Likewise, the particular naming and division of the portions, modules, agents, managers, components, functions, procedures, actions, layers, features, attributes, methodologies and other aspects are not mandatory or significant, and the mechanisms that implement the various embodiments described herein or their features may have different names, divisions and/or formats.

Furthermore, as will be apparent to one of ordinary skill in the relevant art, the portions, modules, agents, managers, components, functions, procedures, actions, layers, features, attributes, methodologies and other aspects of the various embodiments described herein can be implemented as software, hardware, firmware or any combination of the three. Of course, wherever a component of the various embodiments described herein is implemented as software, the component can be implemented as a script, as a standalone program, as part of a larger program, as a plurality of separate scripts and/or programs, as a statically or dynamically linked library, as a kernel loadable module, as a device driver, and/or in every and any other way known now or in the future to those of skill in the art of computer programming. Additionally, the various embodiments described herein are in no way limited to implementation in any specific programming language, or for any specific operating system or environment.

Furthermore, it will be readily apparent to those of ordinary skill in the relevant art that where the various embodiments described herein are implemented in whole or in part in software, the software components thereof can be stored on computer readable media as computer program products. Any form of computer readable medium can be used in this context, such as magnetic or optical storage media. Additionally, software portions of the various embodiments described herein can be instantiated (for example as object code or executable images) within the memory of any programmable computing device.

As will be understood by those familiar with the art, the various embodiments described herein may be embodied in other specific forms without departing from the spirit or essential characteristics thereof. Likewise, the particular naming and division of the portions, modules, agents, managers, components, functions, procedures, actions, layers, features, attributes, methodologies and other aspects are not mandatory or significant, and the mechanisms that implement the various embodiments described herein or their features may have different names, divisions and/or formats. Accordingly, the disclosure of the various embodiments is intended to be illustrative, but not limiting, of the scope of the invention, which is set forth in the following claims.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. A system comprising:

a system processor;

a backplane coupled with the system processor;

a plurality of musical instrument effects modules removably inserted into the backplane, each of the plurality of musical instrument effects modules including an audio input signal interface and an audio output signal interface, at least one of the musical instrument effects modules including a programmable potentiometer or a programmable switch to modify an audio output signal, wherein an ordering of the plurality of musical instrument effects modules is based on a position on the backplane into which the musical instrument effects modules are inserted; and a user interface configured to enable a user to apply a desired setting on a programmable potentiometer or programmable switch of the musical instrument effects modules via the system processor and the backplane.

2. The system of claim 1 including an interface to a configurable switch panel board, the configurable switch panel board including at least one switch to activate or bypass at least one of the plurality of musical instrument effects modules.

3. The system of claim 1 including a touch screen interface and a graphical display interface to support the user interface.

4. The system of claim 1 including a network interface to enable data transfer with a network.

5. The system of claim 1 including a computer interface to enable data transfer with a local computer.

6. The system of claim 1 including a wireless device control interface to enable control of a local audio device.

7. The system of claim 1 wherein each of the plurality of musical instrument effects modules including a control signal interface to control the programmable potentiometer or programmable switch.

8. The system of claim 1 wherein at least one of the musical instrument effects modules including a programmable switch to modify, enable, or disable a musical instrument effects module function.

9. The system of claim 1 wherein the user interface is configured to enable a user to arrange a logical ordering of the plurality of musical instrument effects modules via the system processor and the backplane.

10. The system of claim 1 wherein the system processor is further configured to retain the user applied settings in a system memory.

11. The system of claim 1 wherein the system processor is further configured to automatically program user applied settings retained in a system memory.

12. A method comprising:

removably inserting a plurality of musical instrument effects modules into a backplane, each of the plurality of musical instrument effects modules including an audio input signal interface and an audio output signal interface, at least one of the musical instrument effects modules including a programmable potentiometer or programmable switch to modify an audio output signal, wherein an ordering of the plurality of musical instrument effects modules is based on a position on the backplane into which the musical instrument effects modules are inserted; and manipulating a user interface to apply a desired setting on the programmable potentiometer or programmable switch of the musical instrument effects modules via a system processor and the backplane.

13. The method of claim 12 including attaching a configurable switch panel board to the system processor, and manipulating at least one switch on the configurable switch panel board to activate or bypass at least one of the plurality of musical instrument effects modules.

14. The method of claim 12 including manipulating the user interface to apply a desired setting on a programmable switch of the musical instrument effects modules via the system processor and the backplane.

15. The method of claim 12 including interfacing with a network for a transfer of data with the network.

16. The method of claim 12 including manipulating the user interface to arrange a logical ordering of the plurality of musical instrument effects modules via the system processor and the backplane.

17. The method of claim 12 wherein the system processor is further configured to retain the user applied settings in a system memory.

18. The method of claim 12 wherein the system processor is further configured to automatically program user applied settings retained in a system memory.

* * * * *